US007369806B2

(12) United States Patent
Tomatsu et al.

(10) Patent No.: US 7,369,806 B2
(45) Date of Patent: May 6, 2008

(54) ENGAGEMENT METHOD AND SYSTEM FOR AN IMAGE FORMING APPARATUS

(75) Inventors: Yoshiya Tomatsu, Kasugai (JP); Masahito Kajita, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 216 days.

(21) Appl. No.: 11/192,370

(22) Filed: Jul. 29, 2005

(65) Prior Publication Data

US 2006/0024098 A1 Feb. 2, 2006

(30) Foreign Application Priority Data

Jul. 29, 2004 (JP) ..... 2004-222540

(51) Int. Cl.
*G03G 15/20* (2006.01)

(52) U.S. Cl. ..... 399/333

(58) Field of Classification Search ..... 399/164, 399/167, 330, 333
See application file for complete search history.

(56) References Cited

U.S. PATENT DOCUMENTS 5,752,136 A * 5/1998 Sanchez et al. ..... 399/167
6,393,248 B1 * 5/2002 Tsurusaki et al. ..... 399/330
6,661,986 B2 * 12/2003 Kitayama ..... 399/167
6,671,475 B2 * 12/2003 Katada et al. ..... 399/167
6,963,719 B2 * 11/2005 Jaskowiak ..... 399/333
6,983,118 B2 * 1/2006 Jaskowiak et al. ..... 399/330
7,043,180 B2 * 5/2006 Askren et al. ..... 399/167
7,046,951 B2 * 5/2006 Kim et al. ..... 399/330
7,082,273 B2 * 7/2006 Matsunai ..... 399/330
7,127,203 B1 * 10/2006 Pitts
7,133,637 B2 * 11/2006 Lee ..... 399/330
2005/0129433 A1 * 6/2005 Jaskowiak et al. ..... 399/330
2005/0129435 A1 * 6/2005 Jaskowiak ..... 399/333

FOREIGN PATENT DOCUMENTS

JP 6230706 8/1994
JP 6250576 9/1994
JP 09269691 A * 10/1997
JP 10187009 7/1998
JP 2002372884 12/2002

* cited by examiner

*Primary Examiner*—Susan Lee
(74) *Attorney, Agent, or Firm*—Banner & Witcoff, Ltd.

(57) ABSTRACT

An image forming apparatus includes an engagement piece, connected to a cylindrical member at a crease which extends in a direction crossing a circumferential direction of the cylindrical member, projecting radially outward from the cylindrical member. The engagement piece may engage with a gear to prevent the gear from detaching from the cylindrical member. In addition, the cylindrical member may include a concave portion to engage with a convex portion of the gear. Also, the gear may include a cover portion that includes a communication hole through which a tool may be inserted in order to configure the engagement piece.

29 Claims, 10 Drawing Sheets

ROTATION DIRECTION
64
65
69
70
71
72
73
75
79
F
F
69
70
71

ENGAGEMENT METHOD AND SYSTEM FOR AN IMAGE FORMING APPARATUS

BACKGROUND OF THE INVENTION

1. Field of the Invention

The present invention relates to an image forming apparatus such as a laser printer.

2. Description of the Related Art

An image forming apparatus such as a laser printer has a photoconductor drum, a transfer roller, a heating roller and a pressure roller. The photoconductor drum and the transfer roller are disposed to face each other. The heating roller and the pressure roller are disposed on the downstream side of the photoconductor drum and the transfer roller in the paper conveyance direction so as to face each other. A toner image based on image data is carried on the photoconductor drum. Due to application of transfer bias to the transfer roller, the toner image carried on the photoconductor drum is transferred onto a sheet of paper passing between the photoconductor drum and the transfer roller. After that, the sheet of paper having the toner image transferred thereto passes between the heating roller and the pressure roller. In this event, the sheet of paper is heated by the heating roller and pressed by the pressure roller. Thus, the toner image is fixed onto the sheet of paper so that the formation of an image on the sheet of paper is attained.

In the image forming apparatus configured thus, a gear for rotating the photoconductor drum and the heating roller is provided in an axial end portion of the photoconductor drum or the heating roller so as to rotate integrally with the photoconductor drum or the heating roller due to a driving force input to the gear. To this end, the gear is attached to the photoconductor drum or the heating roller so as to be disabled from rotating relatively thereto.

For example, the following configuration has been known. That is, in the photoconductor drum, a gear is fitted to an end portion of a cylinder made of an aluminum pipe. The end portion of the cylinder is bent inward so as to have a crease in a direction (circumferential direction) perpendicular to the axial direction of the cylinder, so as to engage with a concave portion formed in the outer circumference of the gear. Thus, the gear is attached to the cylinder so as to be disabled from rotating relatively thereto (for example, see JP-A-6-250576).

SUMMARY OF THE INVENTION

In the configuration disclosed in JP-A-6-250576, however, the end portion of the cylinder is bent to have a crease in the circumferential direction of the cylinder. When a force urging the gear outward in the axial direction of the cylinder is applied to the gear, the bent portion is stretched to release the engagement between the end portion of the cylinder and the gear. Thus, there is a problem that the gear is detached from the cylinder so as to drop out.

In order to prevent the gear from dropping out thus, it is necessary to increase the thickness of the cylinder or form the cylinder out of a metal material high in hardness so as to prevent the bent portion in the end portion of the cylinder from being stretched due to such a force applied to the gear. However, when the thickness of the cylinder is increased or the cylinder is formed out of a metal material high in hardness, the cost is increased and the work to bend the end portion of the cylinder in order to attach the gear thereto becomes difficult.

The present invention provides an image forming apparatus in which there occurs no increase in cost or no difficulty in the work to attach a gear to a cylindrical member, but the gear can be prevented from dropping out of the cylindrical member.

According to one aspect of the invention, there is provided an image forming apparatus including: a cylindrical member made of a metal material; a gear attached to an end portion of the cylindrical member; and an engagement piece made by forming a notch on the cylindrical member and is bent to have a crease extending in a direction crossing a circumferential direction of the cylindrical member, the engagement piece engaging with the gear to prevent the gear from dropping out from the cylindrical member.

DETAILED DESCRIPTION OF THE PREFERRED EMBODIMENTS

An embodiment of the invention will be described below with reference to the drawings.

Figure 1:
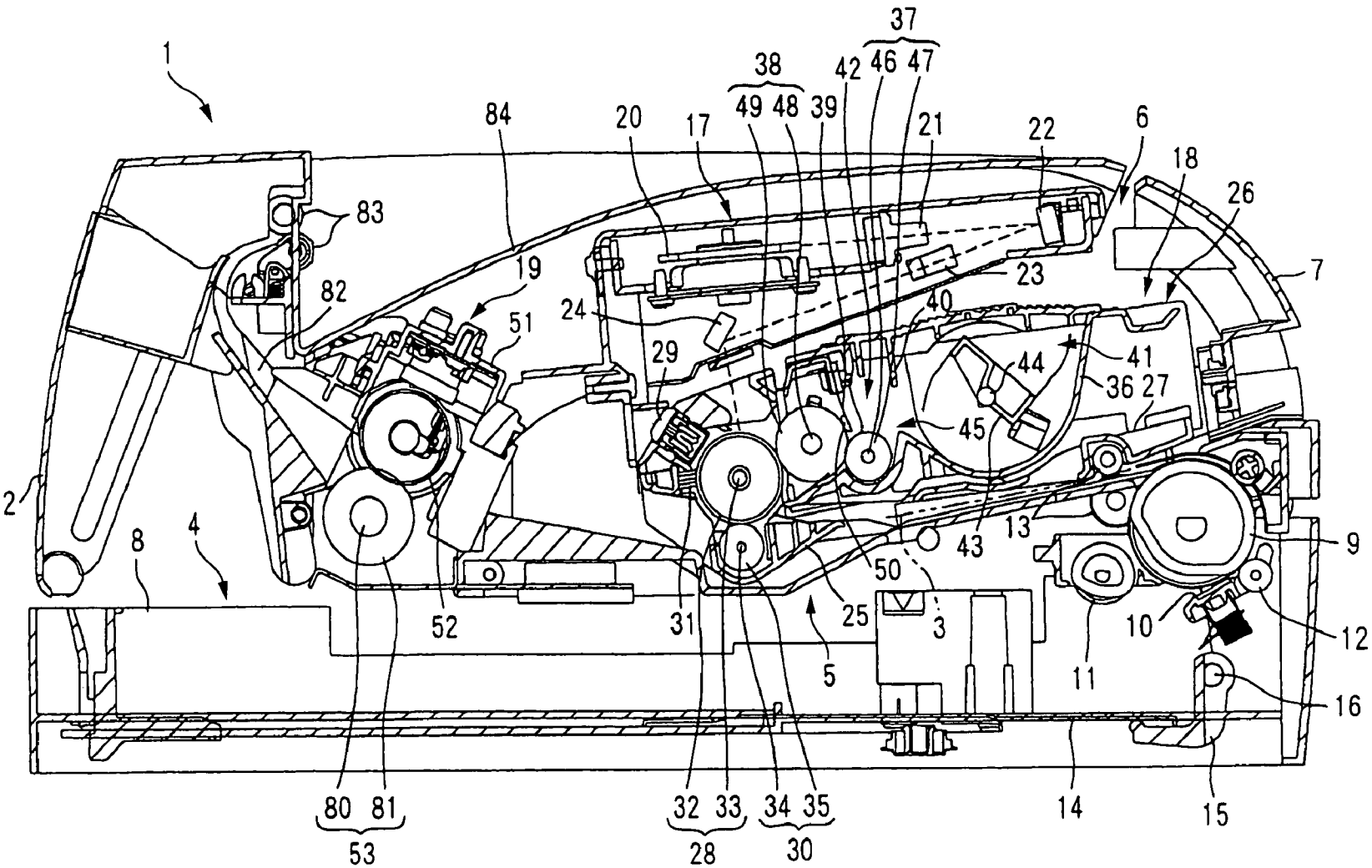
FIG. 1 is a main portion side sectional view showing an embodiment of a laser printer as image forming apparatus according to the invention, showing the state where a front cover has been closed.
Figure 2:
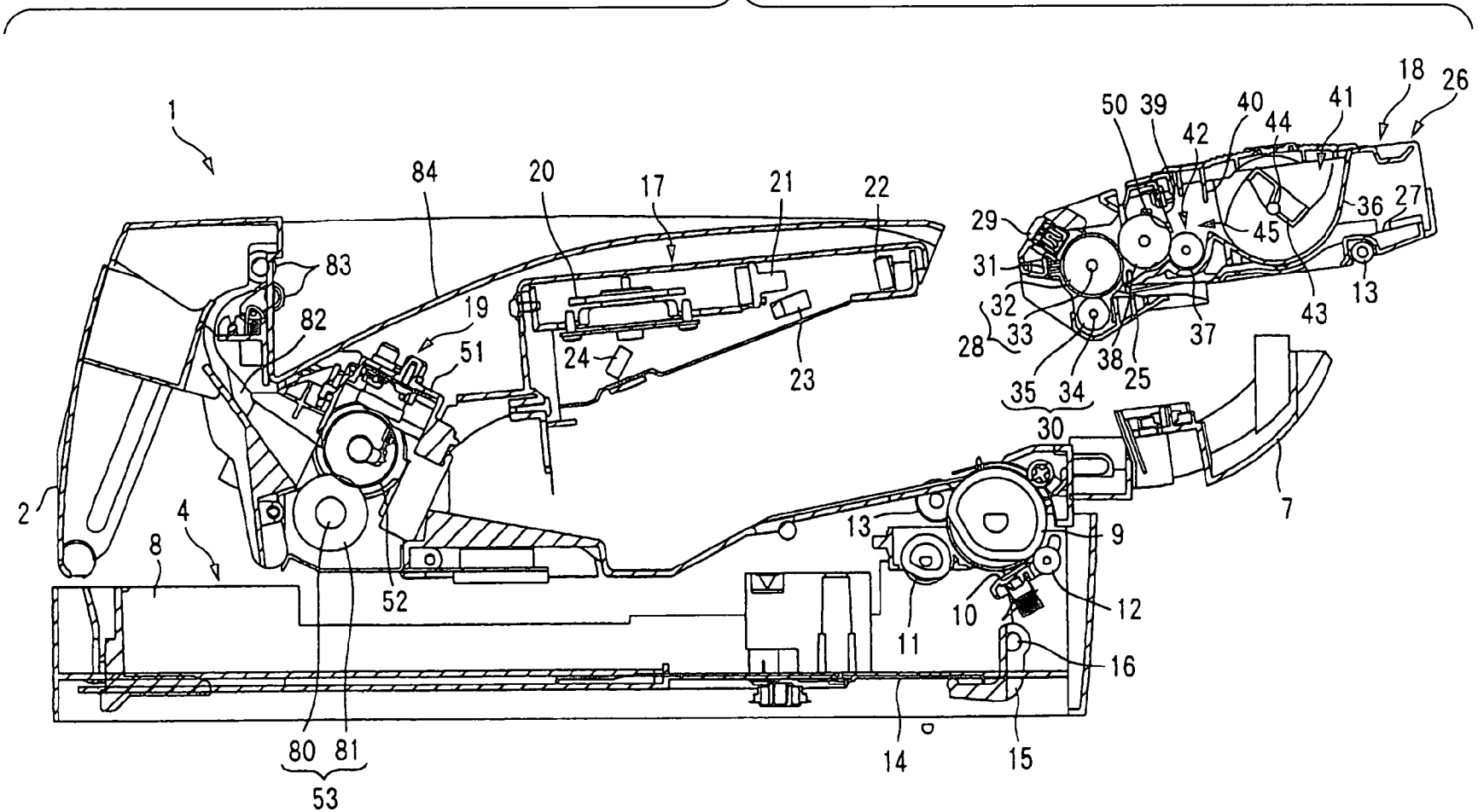
FIG. 2 is a main portion side sectional view of the laser printer shown in FIG. 1, showing the state where the front cover has been opened.

FIGS. 1 and 2 are main portion side sectional views showing an embodiment of a laser printer as image forming apparatus according to the invention. The laser printer 1 has a feeder portion 4 and an image forming portion 5 in a body casing 2. The feeder portion 4 is to feed a sheet of paper 3 as a recording medium, and the image forming portion 5 is to form an image on the fed sheet of paper 3.

In one side wall of the body casing 2, an insertion opening portion 6 for attaching/detaching a process cartridge 18 which will be described later is formed, and a front cover 7 for opening/closing the insertion opening portion 6 is provided.

The front cover 7 is supported rotatably on a not-shown cover shaft inserted into the lower end portion of the front cover 7. When the front cover 7 is closed around the cover shaft, the insertion opening portion 6 is closed by the front cover 7 as shown in FIG. 1. When the front cover 7 is opened (tilted) with the cover shaft as a fulcrum, the insertion opening portion 6 is opened as shown in FIG. 2. Thus, the process cartridge 18 can be attached/detached to/from the body casing 2 through the insertion opening portion 6.

In the following description, assume that the side where the front cover 7 is provided is regarded as the "front side" and the opposite side is regarded as the "rear side" in the laser printer 1 and the process cartridge 18 (including a development cartridge 26 which will be described later).

The feeder portion 4 has a paper feed tray 8, a paper feed roller 9, a separation pad 10, a pickup roller 11, a pinch roller 12 and a registration roller 13 in the bottom portion of the body casing 2. The paper feed tray 8 is removably attached. The paper feed roller 9 and the separation pad 10 are provided above the front end portion of the paper feed tray 8. The pickup roller 11 is provided at the rear of the paper feed roller 9. The pinch roller 12 is disposed under the front side of the paper feed roller 9 so as to face the paper feed roller 9. The registration roller 13 is provided above the rear side of the paper feed roller 9.

A paper pressure plate 14 on which a stack of sheets of paper 3 can be loaded is provided inside the paper feed tray 8. The paper pressure plate 14 is supported rockably in its rear end so that the front end portion of the paper pressure plate 14 can move in the up/down direction.

In addition, the front end portion of the paper feed tray 8 is provided with a lever 15 for lifting up the front end portion of the paper pressure plate 14. The lever 15 is formed into an approximate L-shape in section so as to round the paper pressure plate 14 from its front side to its bottom side. The upper end portion of the lever 15 is attached to a lever shaft 16 provided in the front end portion of the paper feed tray 8, and the rear end portion of the lever 15 abuts against the front end portion of the bottom surface of the paper pressure plate 14. When a driving force to rotate the lever 15 clockwise in FIGS. 1 and 2 is input to the lever shaft 16, the lever 15 rotates with the lever shaft 16 as a fulcrum so that the rear end portion of the lever 15 lifts up the front end portion of the paper pressure plate 14.

When the front end portion of the paper pressure plate 14 is lifted up, the uppermost sheet of paper 3 on the paper pressure plate 14 is pressed onto the pickup roller 11, and begins to be conveyed to between the paper feed roller 9 and the separation pad 10 due to the rotation of the pickup roller 11.

On the other hand, when the paper feed tray 8 is detached from the body casing 2, the front end portion of the paper pressure plate 14 moves down due to its own weight so that the paper pressure plate 14 lies along the bottom surface of the paper feed tray 8. In this state, a stack of sheets of paper 3 can be loaded onto the paper pressure plate 14.

As soon as sheets of paper 3 fed to between the paper feed roller 9 and the separation pad 10 by the pickup roller 11 are inserted between the paper feed roller 9 and the separation pad 10 by the rotation of the paper feed roller 9, the sheets of paper 3 are surely separated and fed one by one. Each fed sheet of paper 3 passes between the paper feed roller 9 and the pinch roller 12 and is conveyed to the registration roller 13.

The registration roller 13 is constituted by a pair of rollers opposed to each other. The registration roller 13 registers the sheet of paper 3 and then conveys the sheet of paper 3 to a transfer position (a below-mentioned nip position between the photoconductor drum 28 and the transfer roller 30, where a toner image on the photoconductor drum 28 will be transferred to the sheet of paper 3) of the image forming portion 5.

The image forming portion 5 has a scanner portion 17, a process cartridge 18 and a fixation portion 19.

The scanner portion 17 is provided in the upper portion of the body casing 2, and provided with a not-shown laser light source, a polygon mirror 20 to be driven to rotate, an fθ lens 21, a reflecting mirror 22, a lens 23, a reflecting mirror 24, etc. As illustrated by the chain line, a laser beam emitted from the laser light source based on image data is deflected by the polygon mirror 20 so as to pass the fθ lens 21. After that, the optical path of the laser beam is folded back by the reflecting mirror 22 so that the laser beam further passes the lens 23. After that, the optical path of the laser beam is further bent downward by the reflecting mirror 24. Thus, the surface of the below-mentioned photoconductor drum 28 of the process cartridge 18 is irradiated with the laser beam by a high-speed scan.

Under the scanner portion 17, the process cartridge 18 is removably attached to the body casing 2. The process cartridge 18 has a drum cartridge 25 and a development cartridge 26 removably attached to the drum cartridge 25.

The drum cartridge 25 has a pair of side plates 27 disposed to extend in the front/rear direction and face each other in a direction perpendicular to the front/rear direction (hereinafter referred to as "width direction" simply). Between the side plates 27, the development cartridge 26 is attached to the front side of the drum cartridge 25, and the photoconductor drum 28, a scorotron type charger 29, the transfer roller 30 and a cleaning brush 31 are provided in the rear side of the drum cartridge 25.

The photoconductor drum 28 has a cylindrical drum body 32 and a drum shaft 33. The outermost layer of the drum body 32 is formed out of a positive-chargeable photoconductor layer made of polycarbonate or the like. The drum shaft 33 is made of metal and located in the axis of the drum body 32 so as to extend in the longitudinal direction of the drum body 32. The drum shaft 33 is supported on the opposite side plates 27 of the drum cartridge 25 so as to be disabled from rotating, and the drum body 32 is rotatably supported on the drum shaft 33. Thus, the photoconductor drum 28 is provided rotatably around the drum shaft 33 between the opposite side plates 27.

The scorotron type charger 29 is disposed diagonally above the rear side of the photoconductor drum 28 so as to face the photoconductor drum 28 at a distance therefrom without abutting against the photoconductor drum 28. The scorotron type charger 29 is a scorotron type positive charger for generating corona discharge from a charging wire of tungsten or the like. The scorotron type charger 29 is provided to be able to charge the surface of the photoconductor drum 29 uniformly to positive polarity.

The transfer roller 30 is rotatably supported on the opposite side plates 27 of the drum cartridge 25. The transfer roller 30 is disposed to face the photoconductor drum 28 in contact therewith from below in the up/down direction so as to form a nip between the transfer roller 30 and the photoconductor drum 28. The transfer roller 30 is constituted by a roller shaft 34 and a roller 35. The roller shaft 34 is made of metal. The roller 35 is made of a conductive rubber material and covers the roller shaft 34. Transfer bias is applied to the transfer roller 30 at the time of transfer.

The cleaning brush 31 is disposed at the rear of the photoconductor drum 28 so that the head of the brush abuts against the surface of the drum body 32 of the photoconductor drum 28.

The development cartridge 26 is removably attached to the drum cartridge 25. The development cartridge 26 has a housing 36, a feed roller 37, a development roller 38 and a layer thickness limiting blade 39. The housing 36 is shaped into a box which is open on the rear side. The feed roller 37, the development roller 38 and the layer thickness limiting blade 39 are provided inside the housing 36. The development cartridge 26 can be attached/detached to/from the body casing 2 together with the drum cartridge 25. The development cartridge 26 can be also attached/detached to/from the body casing 2 independently of the drum cartridge 25 attached to the body casing 2.

In the housing 36, a partition plate 40 is provided to project downward from the top of the housing 36 and extend in the width direction of the housing 36. An internal space in front of the partition plate 40 is set as a toner storage chamber 41, and an internal space at the rear of the partition plate 40 is set as a development chamber 42.

Positive-chargeable non-magnetic monocomponent toner is stored as developer in the toner storage chamber 41. Toner available as this toner is polymerized toner obtained by copolymerizing polymeric monomer, for example, styrene-based monomer such as styrene, or acrylic-based monomer such as acrylic acid, alkyl (C1 to C4) acrylate, alkyl (C1 to C4) methacrylate by a well-known polymerizing method such as suspension polymerization. The polymerized toner is spherical and extremely excellent in fluidity, whereby a high quality image can be formed.

Incidentally, colorant such as carbon black, wax, etc. are blended with the toner. In order to improve the fluidity, an external additive such as silica is also added to the toner. The particle size of the toner is about 6-10 μm.

An agitator 43 for agitating the toner in the toner storage chamber 41 is also provided in the toner storage chamber 41. In the central portion of the toner storage chamber 41, the agitator 43 is supported on an agitator rotating shaft 44 extending in the width direction. The agitator 43 is rotated with the agitator rotating shaft 44 as a fulcrum, whereby the toner in the toner storage chamber 41 is agitated and discharged from a toner discharge hole 45 under the partition plate 40 toward the development chamber 42.

The feed roller 37 is disposed in the lower front side of the development chamber 42 and rotatably supported between the opposite side plates of the housing 36, which plates are opposed to each other in the width direction of the housing 36. The feed roller 37 has a feed roller shaft 46 and a sponge roller 47. The feed roller shaft 46 is made of metal and extends in the width direction of the feed roller 37. The sponge roller 47 is made of a conductive foam and covers the circumference of the feed roller shaft 46.

The development roller 38 is disposed in the rear lower side of the development chamber 42 and rotatably supported between the opposite side plates of the housing 36, which plates are opposed to each other in the width direction of the housing 36. In addition, the development roller 38 is disposed so that a part of the surface thereof projects rearward so as to be exposed from the housing 36. When the development cartridge 26 is attached to the drum cartridge 25, the development roller 38 faces the photoconductor drum 28 in the front/rear direction and abuts against the photoconductor drum 28. The development roller 38 has a development roller shaft 48 and a rubber roller 49. The development roller shaft 48 is made of metal. The rubber roller 49 is made of a conductive rubber material and covers the circumference of the development roller shaft 48. The rubber roller 49 is made of conductive urethane rubber or silicon rubber containing carbon particulates etc., and the surface of the rubber roller 49 is covered with fluorine-containing urethane rubber or silicon rubber. The rubber roller 49 is disposed in contact with the sponge roller 47 of the feed roller 37 so that the rubber roller 49 and the sponge roller 47 are compressed by each other.

The layer thickness limiting blade 39 is made of a metal plate spring, and provided with a sectionally semicircular pressure rubber member 50 on its edge portion. The pressure rubber member 50 is made of insulating silicon rubber. The layer thickness limiting blade 39 is supported on the housing 36 above the development roller 38 so that the lower end portion of the layer thickness limiting blade 39 faces the rubber roller 49 of the development roller 38 from its front side. Thus, the pressure rubber member 50 is brought into pressure contact with the rubber roller 49 due to the elastic force of the layer thickness limiting blade 39.

The toner discharged from the toner discharge hole 45 to the development chamber 42 by the rotation of the agitator 43 is supplied onto the rubber roller 49 of the development roller 38 by the rotation of the feed roller 37. In this event, the toner is positively tribocharged between the sponge roller 47 of the feed roller 37 and the rubber roller 49 of the development roller 38. The toner supplied onto the rubber roller 49 is inserted between the pressure rubber member 50 of the layer thickness limiting blade 39 and the rubber roller 49 with the rotation of the development roller 38 so as to be formed into a thin layer with a predetermined thickness. Thus, the toner is carried on the rubber roller 49.

On the other hand, the surface of the photoconductor drum 28 is positively charged uniformly by the scorotron type charger 29, and then exposed by a high-speed scan with a laser beam from the scanner portion 17. Thus, an electrostatic latent image based on image data is formed on the surface of the photoconductor drum 28.

Next, due to the rotation of the development roller 38, the positively charged toner carried on the rubber roller 49 of the development roller 38 faces and abuts against the photoconductor drum 28. In this event, the toner is supplied to the electrostatic latent image formed on the surface of the photoconductor drum 28, that is, of the surface of the photoconductor drum 28 charged positively uniformly, an exposed portion whose potential has been dropped down due to the exposure to the laser beam. In this manner, the toner is selectively carried on the surface of the photoconductor drum 28. Thus, the electrostatic latent image is visualized so that a toner image is formed by a reversal process.

After that, the photoconductor drum 28 and the transfer roller 30 are driven and rotated to convey the sheet of paper 3 while nipping the sheet of paper 3 therebetween. Thus, the sheet of paper 3 is conveyed between the photoconductor drum 28 and the transfer roller 30, whereby the toner image carried on the surface of the photoconductor drum 28 is transferred onto the sheet of paper 3.

When the surface of the photoconductor drum 28 faces the brush of the cleaning brush 31 after the transfer, paper powder adhering to the surface of the photoconductor drum 28 due to the contact with the sheet of paper 3 is removed by the brush with the rotation of the photoconductor drum 28.

The fixation portion 19 has a fixation frame 51, a heating roller 52 and a pressure roller 53. The fixation frame 51 is provided on the rear side of the process cartridge 18 so as to extend in the width direction thereof. The heating roller 52 and the pressure roller 53 are rotatably supported on the fixation frame 51 and disposed to face each other in the up/down direction.

Figure 3:
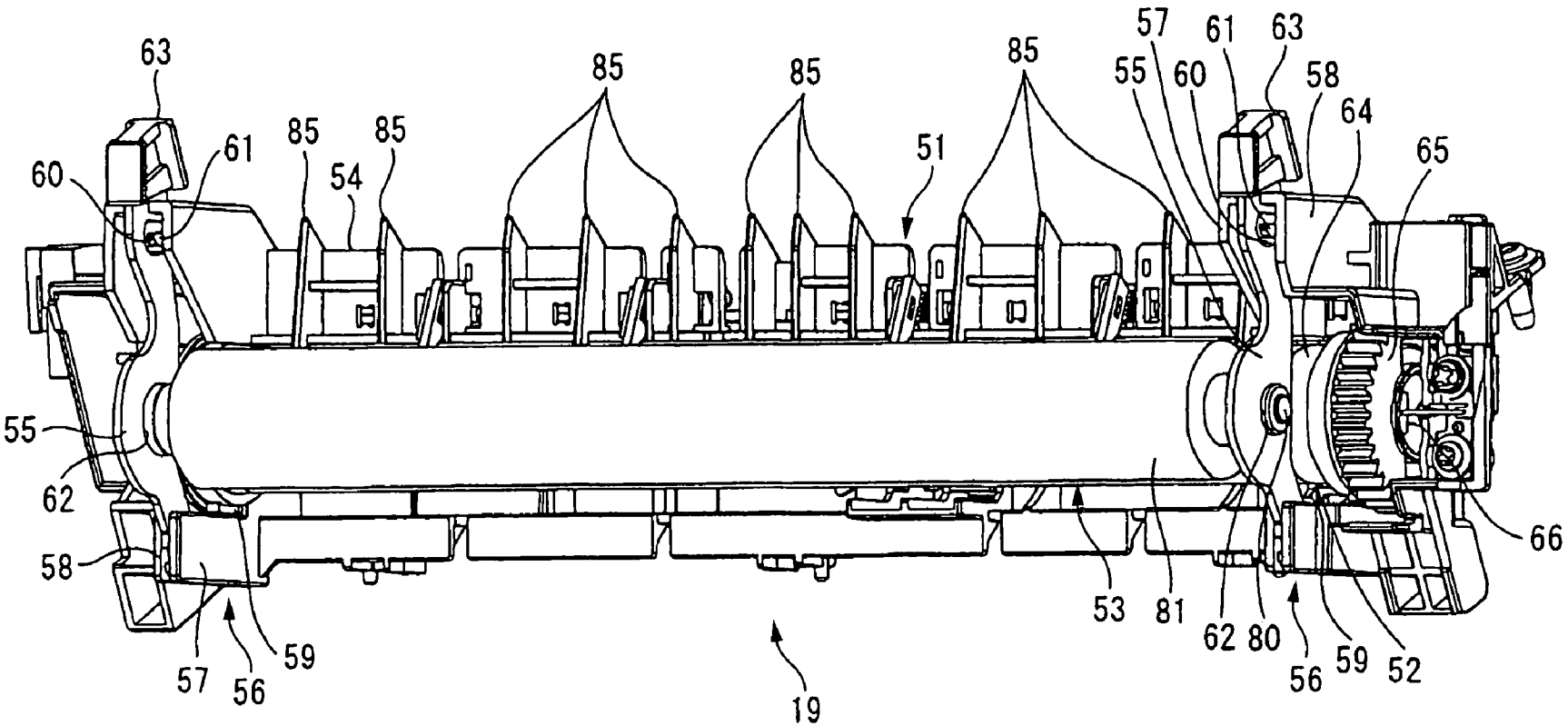
FIG. 3 is a perspective view in which a fixation portion shown in FIG. 1 is observed from below.

The fixation frame 51 has a frame body 54 and a pair of roller support arms 55 as shown in FIG. 3.

Support wall portions 56 are formed in the longitudinal (width-direction) end portions of the frame body 54 respectively so as to project downward and extend in a direction (front/rear direction) perpendicular to the longitudinal direction of the frame body 54. Between the support wall portions 56 in the frame body 54, a plurality of ribs 85 for guiding the upper surface of the sheet of paper 3 are formed at intervals in the longitudinal direction of the frame body 54 so as to extend in a direction perpendicular to the longitudinal direction.

Each support wall portion 56 has an inner side wall 57 and an outer side wall 58 disposed oppositely at a distance from each other in the longitudinal direction of the frame body 54. Each inner side wall 57 is notched from its lower edge so as to form a base pipe reception portion 59 for receiving an axial end portion of a below-mentioned metal base pipe 64 of the heating roller 52. In addition, a lock shaft 60 in which a below-mentioned lock nail 61 of each roller support arm 55 will be locked is provided in a rear end portion between the inner side wall 57 and the outer side wall 58.

Each roller support arm 55 is disposed between the inner side wall 57 and the outer side wall 58 of the corresponding support wall portion 56, and provided to extend in a direction perpendicular to the longitudinal direction of the frame body 54. A longitudinal end portion (front end portion) of each roller support arm 55 is rotatably supported on a not-shown shaft provided between the inner side wall 57 and the outer side wall 58 of the corresponding support wall portion 56, and the other longitudinal end portion (rear end portion) is provided with a lock nail 61 which can be locked in the lock shaft 60 of the support wall portion 56. In addition, a shaft insertion hole 62 is formed in the longitudinal halfway portion of each roller support arm 55. A below-mentioned pressure roller shaft 80 of the pressure roller 53 is inserted into the shaft insertion hole 62 so as to be rotatably supported therein. Further, in the other longitudinal end of each roller support arm 55, an operation portion 63 to be operated for locking the lock nail 61 in the lock shaft 60 or releasing the lock nail 61 from the lock shaft 60 is provided at the rear of the lock nail 61.

Figure 4:
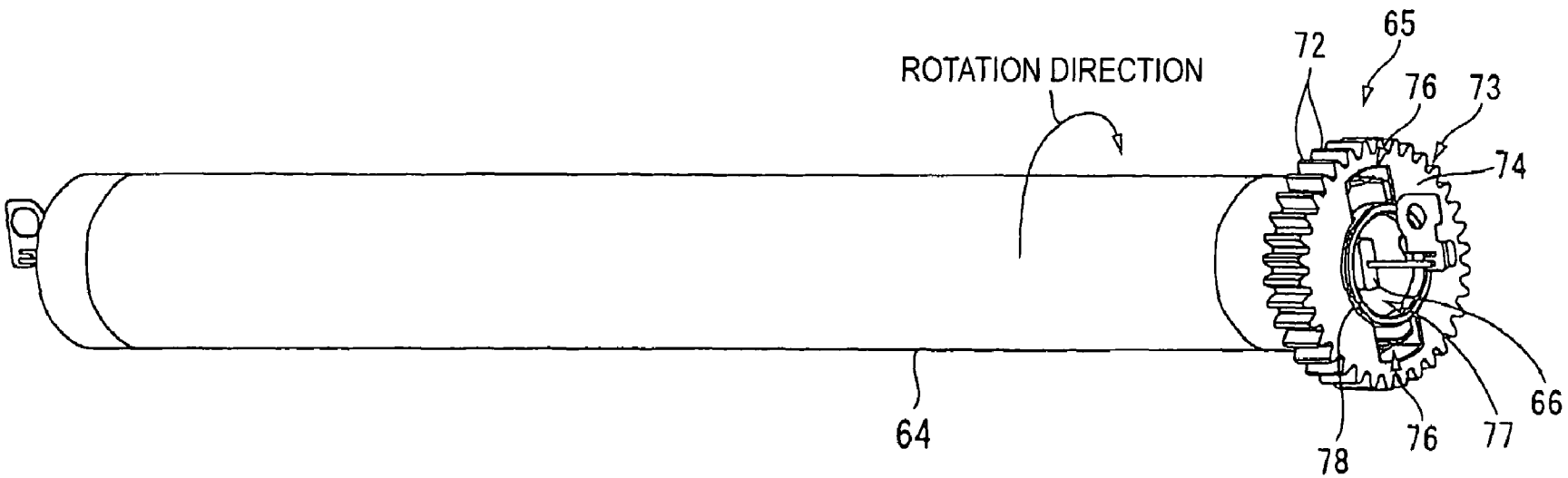
FIG. 4 is a perspective view of a heating roller shown in FIG. 3.

The heating roller 52 has a metal base pipe 64 as a cylindrical member, a roller drive gear 65 as a gear, and a halogen lamp 66 as an internal insertion member, as shown in FIG. 4.

Figure 5:
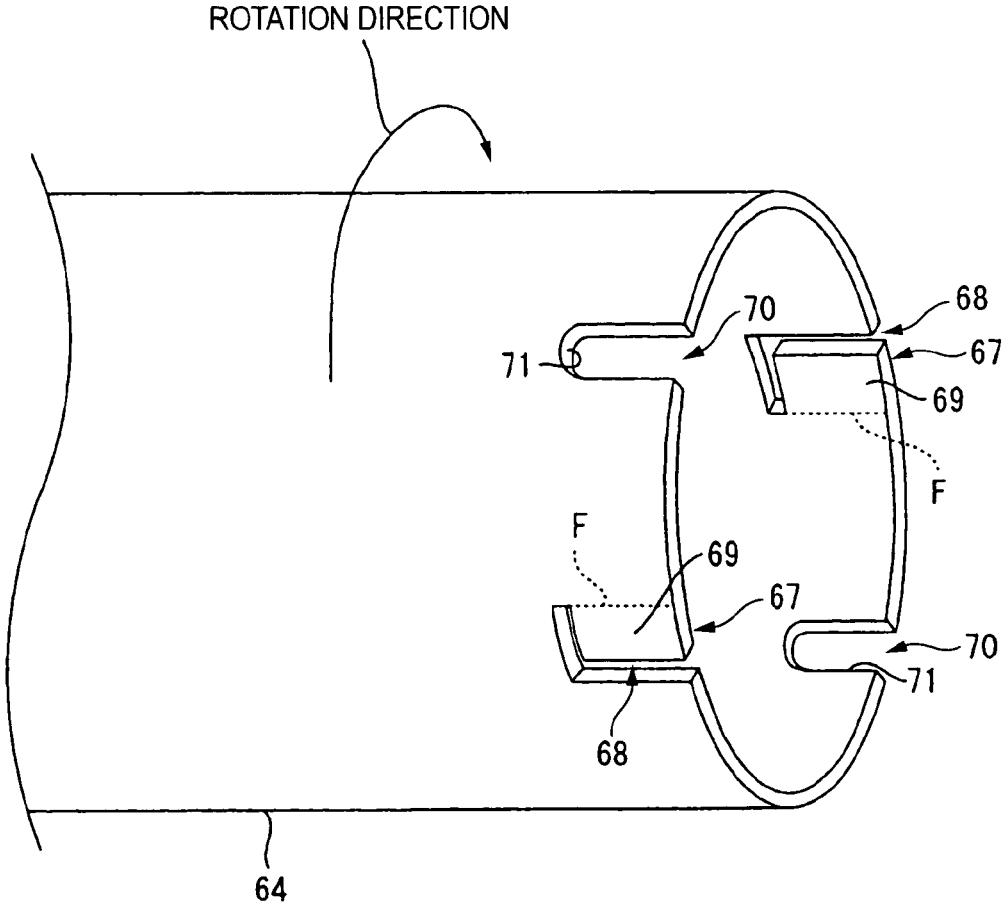
FIG. 5 is a perspective view of an end portion of a metal base pipe shown in FIG. 4.

The metal base pipe 64 is made of a metal material such as aluminum, and formed into a cylindrical shape extending in the width direction. In one longitudinal end portion of the metal base pipe 64, hook-like (approximately L-shaped) notches 68 are made in engagement piece formation positions 67 symmetric with respect to the central axis of the metal base pipe 64 as shown in FIG. 5. The notches 68 are bent to extend inward in the axial direction of the metal base pipe 64 from its edge and then extend in the circumferential direction of the metal base pipe 64 and downstream in the rotation direction of the heating roller 52. Thus, engagement pieces 69 are formed so that each engagement piece 69 can be bent to have a crease F extending in parallel to the axial direction of the metal base pipe 64.

In addition, the one longitudinal end portion of the metal base pipe 64 is notched into an approximate U-shape inward in the axial direction of the metal base pipe 64 from its edge. Thus, concave portions 71 are formed in concave portion formation positions 70 symmetric with respect to the central axis of the metal base pipe 64. Each concave portion formation position 70 is set in a position where a straight line passing an engagement piece formation position 67 and a straight line passing the concave portion formation position 70 cross each other at right angles. That is, the engagement pieces 69 and the concave portions 71 are formed alternately at every central angle of 90 degrees around the central axis of the metal base pipe 64 in the one longitudinal end portion of the metal base pipe 64.

Figure 7:
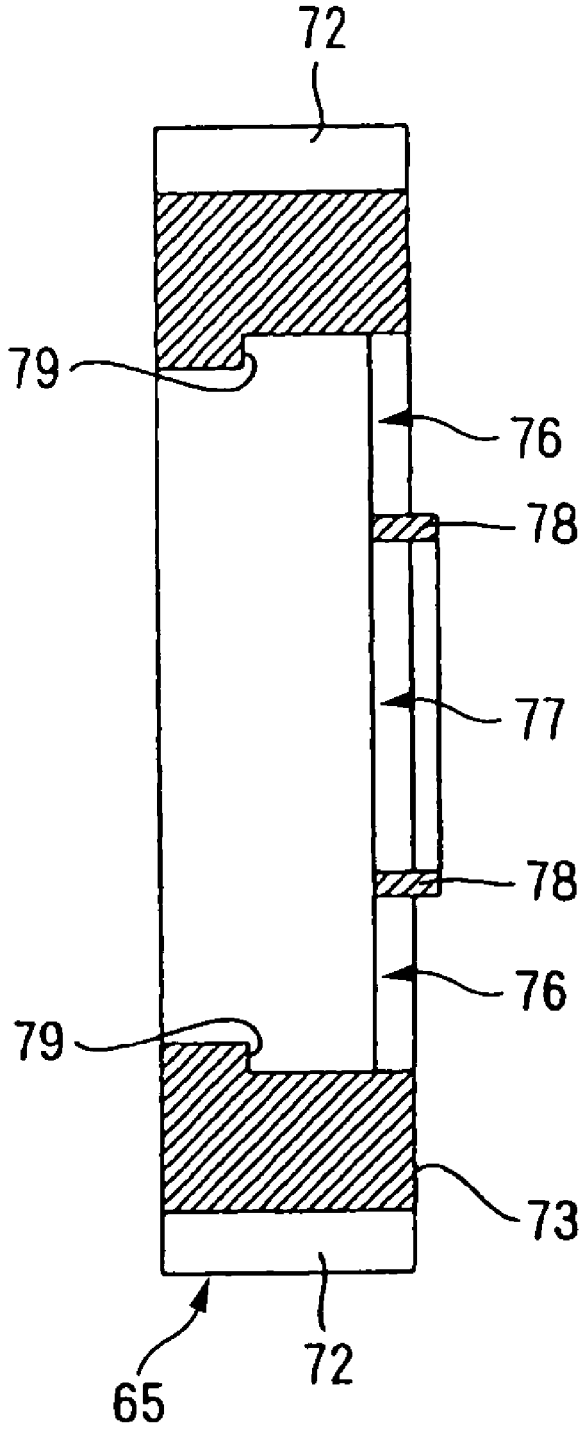
FIG. 7 is a sectional view of the roller drive gear shown in FIGS. 6A and 6B.

The roller drive gear 65 is attached to the one longitudinal end portion of the metal base pipe 64 as shown in FIG. 4. As shown in FIG. 7, the roller drive gear 65 is substantially shaped like a U-figure in section and integrally provided with a gear portion 73 having a plurality of gear teeth 72 in its circumferential surface, and a cover portion 74 formed to close the internal space of the gear portion 73.

Figure 6A:
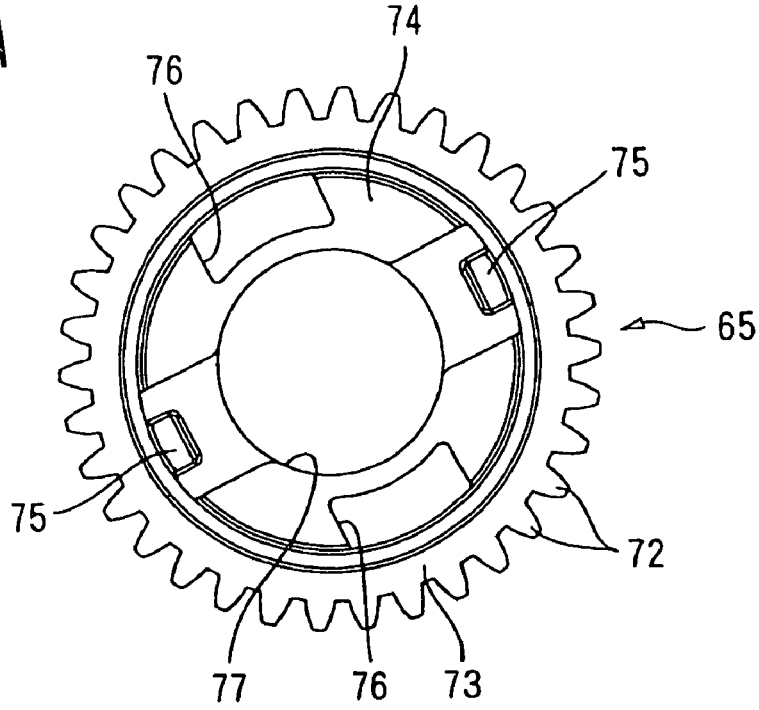
FIG. 6A is a bottom view of a roller drive gear shown in FIG. 4.

A driving force from a not-shown motor disposed in the body casing 2 (see FIG. 1) is input to the gear teeth 72 of the gear portion 73. The gear portion 73 has a cylindrical inner circumferential surface. In the inner circumferential surface, convex portions 75 which can engage with the concave portions 71 of the metal base pipe 64 respectively are formed in positions symmetric with respect to the central axis, so that each convex portion 75 has an approximately rectangular shape projecting inward in the radial direction, as shown in FIG. 6A.

Figure 6B:
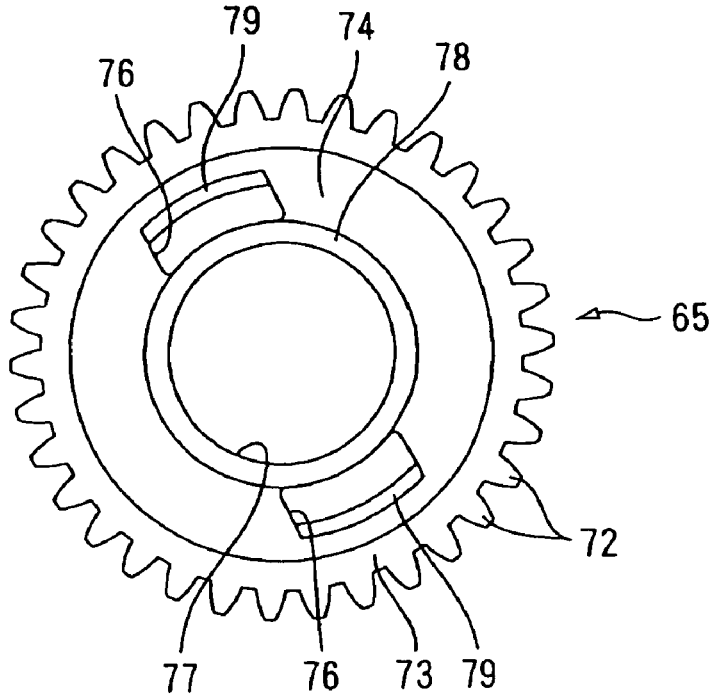
FIG. 6B is a plan view of the roller drive gear.

The cover portion 74 is formed into a disc-like shape, and disposed outward in the axial direction of the metal base pipe 64 with respect to the gear portion 73 in the state where the roller drive gear 65 has been attached to the metal base pipe 64. In the cover portion 74, as shown in FIG. 4, approximately rectangular communication holes 76 allowing the outside and the inside of the metal base pipe 64 to communicate with each other are formed in positions opposed to the engagement pieces 69 of the metal base pipe 64 in the axial direction of the metal base pipe 64 respectively in the state where the roller drive gear 65 has been attached to the metal base pipe 64. In addition, in the cover portion 74, a circular insertion hole 77 through which the halogen lamp 66 will be inserted into the metal base pipe 64 is formed on the radially inner side with respect to the respective communication holes 76, as shown in FIG. 6B. Further, in the surface (outer surface in the axial direction of the metal base pipe 64) of the cover portion 74, an annular rib 78 is formed along the circumference of the insertion hole 77.

In the roller drive gear 65, as shown in FIG. 7, in the inner circumferential surface of the gear portion 73, portions radially adjacent to the communication holes 76 respectively are notched so that steps 79 are formed in the inner circumferential surface of the gear portion 73.

The roller drive gear 65 is attached to the metal base pipe 64 as follows. That is, the metal base pipe 64 and the roller drive gear 65 are positioned so that the concave portions 71 of the metal base pipe 64 are opposed to the convex portions 75 of the roller drive gear 65 respectively. One longitudinal end portion of the metal base pipe 64 is fitted to the inner circumferential surface of the gear portion 73 of the roller drive gear 65 so that the concave portions 71 and the convex portions 75 engage each other respectively. In this state, the communication holes 76 of the roller drive gear 65 face the engagement pieces 69 of the metal base pipe 64 respectively in the axial direction of the metal base pipe 64. After that, a tool (not shown) is inserted into the metal base pipe 64 through each communication hole 76. Each engagement piece 69 is bent outward in the radial direction of the metal base pipe 64 by the tool so as to form a crease F extending in parallel to the central axis of the metal base pipe 64.

Thus, the engagement pieces 69 project to the radially outer side of the metal base pipe 64 so that the free end portions of the engagement pieces 69 are locked in the steps 79 of the inner circumferential surface of the gear portion 73 respectively from the axially outer side of the metal base pipe 64. Thus, the attachment of the roller drive gear 65 to the metal base pipe 64 is attained. In this state, the engagement pieces 69 are locked in the steps 79 respectively, whereby the roller drive gear 65 is fixed to the metal base pipe 64 in the axial direction of the metal base pipe 64. In addition, the convex portions 75 engage with the concave portions 71 respectively, whereby the roller drive gear 65 is also fixed to the metal base pipe 64 in the rotation direction of the roller drive gear 65. Therefore, not only is it possible to prevent the roller drive gear 65 from being detached from the metal base pipe 64, but it is also possible to rotate the metal base pipe 64 and the roller drive gear 65 integrally due to a driving force when the driving force is input from a not-shown motor to the roller drive gear 65.

The pressure roller 53 includes a pressure roller shaft 80 made of metal and a rubber roller 81 made of a rubber material and covering the circumference of the pressure roller shaft 80, as shown in FIG. 3. The opposite end portions of the pressure roller shaft 80 are inserted into shaft insertion holes 62 of the roller support arms 55 respectively so that the pressure roller 53 is rotatably supported in the shaft insertion holes 62. In the state where the lock nails 61 of the roller support arms 55 have been locked in the lock shafts 60 of the frame body 54 respectively, the rubber roller 81 is elastically pressed against the metal base pipe 64 of the heating roller 52 so that the pressure roller 53 is driven by the rotation of the heating roller 52. When there occurs a jam between the heating roller 52 and the pressure roller 53, the lock nails 61 of the roller support arms 55 are released from the lock shafts 60 of the frame body 54 respectively, and the roller support arms 55 are rotated. Thus, the pressure roller 53 can be detached from the heating roller 52.

In the fixation portion 19, as shown in FIG. 1, the toner transferred onto the sheet of paper 3 is thermally fixed when the sheet of paper 3 passes between the heating roller 52 and the pressure roller 53. The sheet of paper 3 on which the toner has been fixed is conveyed to a paper ejection path 82 extending in the up/down direction toward the top of the body casing 2. The sheet of paper 3 conveyed to the paper ejection path 82 is ejected onto a paper ejection tray 84 formed on the top of the body casing 2 by paper ejection rollers 83 provided in the upper end of the paper delivery path 82.

According to the configuration described above, each engagement piece 69 in the heating roller 52 is bent to have a crease F extending in parallel to the axial direction of the metal base pipe 64 so that the roller drive gear 65 is fixed to the metal base pipe 64 in the axial direction of the metal base pipe 64. Accordingly, even when a force urging the roller drive gear 65 to the axially outer side of the metal base pipe 64 is applied to the roller drive gear 65, the bent portion of each engagement piece 69 can be surely prevented from being stretched. Thus, the roller drive gear 65 can be surely prevented from dropping out of the metal base pipe 64. As a result, it can be made unnecessary to increase the thickness of the metal base pipe 64 or form the metal base pipe 64 out of a high-hardness metal material in order to prevent such dropping out. Thus, the roller drive gear 65 can be surely prevented from dropping out of the metal base pipe 64, without increasing the cost or making it difficult to attach the roller drive gear 65.

Particularly the metal base pipe 64 is heated in the heating roller 52 at the time of forming an image. Thus, the metal base pipe 64 is deformed easily. Even when a force urging the roller drive gear 65 to the axially outer side of the metal base pipe 64 is applied to the roller drive gear 65 in such a state, the bent portion of each engagement piece 69 can be prevented from being stretched. Thus, the roller drive gear 65 can be surely prevented from dropping out of the metal base pipe 64.

In addition, the engagement pieces 69 are formed by the notches 68 made from the edge of the metal base pipe 64 on the side where the roller drive gear 65 will be attached, so that one side of each engagement piece 69 is formed out of the edge of the metal base pipe 64. Thus, the labor required for forming each engagement piece 69 can be reduced. In addition, since the engagement pieces 69 are provided in one end portion of the metal base pipe 64, the axial size of the roller drive gear 65 can be set to be as small as possible.

Further, each notch 68 is formed like a hook so that each engagement piece 69 can be formed easily. Accordingly, the labor required for forming each engagement piece 69 can be further reduced. In addition, when each notch 68 is formed like a hook, the engagement of each engagement piece 69 with the roller drive gear 65 can be made surer.

In addition, since the engagement pieces 69 are bent to the radially outer side of the metal base pipe 64, the intervals of the positions where the engagement pieces 69 engage with the steps 79 of the inner circumferential surface of the gear portion 73 respectively can be secured to be wide in the circumferential direction. Accordingly, the looseness between the metal base pipe 64 and the roller drive gear 65 can be reduced.

Further, since the gear portion 73 is disposed on the outer side of the metal base pipe 64, the gear portion 73 can be prevented from being heated directly by heating from the halogen lamp 66.

That is, if a part of the roller drive gear 65 is disposed on the inner side of the metal base pipe 64, the part of the roller drive gear 65 disposed on the inner side of the metal base pipe 64 will be heated directly by heating from the halogen lamp 66. However, in the configuration where each engagement piece 69 is bent to the radially outer side of the metal base pipe 64, the roller drive gear 65 can be disposed on the outer side of the metal base pipe 64. Thus, the roller drive gear 65 can be prevented from being heated directly by heating from the halogen lamp 66.

In addition, since the cover portion 74 of the roller drive gear 65 covers the opening of the metal base pipe 64, the cover portion 74 can prevent foreign matters from entering the metal base pipe 64. Further, the communication holes 76 are formed in the cover portion 74 so as to be located in positions opposed to the engagement pieces 69 in the axial direction of the metal base pipe 64 respectively. Accordingly, the engagement pieces can be bent through the communication holes 76 respectively. Thus, it is possible to prevent the cover portion 74 from hindering the bending of the engagement pieces 69.

Furthermore, the insertion hole 77 is formed in the cover portion 74. Accordingly, the halogen lamp 66 can be inserted into the metal base pipe 64 through the insertion hole 77. Thus, it is possible to prevent the cover portion 74 from hindering the insertion of the halogen lamp 66.

Moreover, due to the annular rib 78 formed along the circumference of the insertion hole 77, the strength of the cover portion 74 can be secured while the halogen lamp 66 can be inserted into the metal base pipe 64.

In addition, the convex portions 75 are formed in the roller drive gear 65 while the concave portions 71 corresponding to the convex portions 75 respectively are formed in the metal base pipe 64. Accordingly, in the state where the roller drive gear 65 has been attached to the metal base pipe 64, the convex portions 75 engage with the concave portions 71 respectively, whereby the roller drive gear 65 can be fixed to the metal base pipe 64 in the rotation direction thereof. Thus, the torque of the roller drive gear 65 can be surely transmitted to the metal base pipe 64 while the load (torque) on each engagement piece 69 can be reduced when the heating roller 52 is rotating.

Further, the engagement pieces 69 and the concave portions 71 are formed alternately at every central angle of 90 degrees around the central axis of the metal base pipe 64. Accordingly, the positions where the engagement pieces 69 are locked respectively and the positions where the concave portions 71 engage with the convex portions 75 respectively are disposed alternately at an equal angle interval of 90 degrees around the central axis of the metal base pipe 64. Thus, the roller drive gear 65 can be stably attached to the metal base pipe 64. It is therefore possible to prevent looseness between the metal base pipe 64 and the roller drive gear 65 when the heating roller 52 is rotating.

Figure 8:
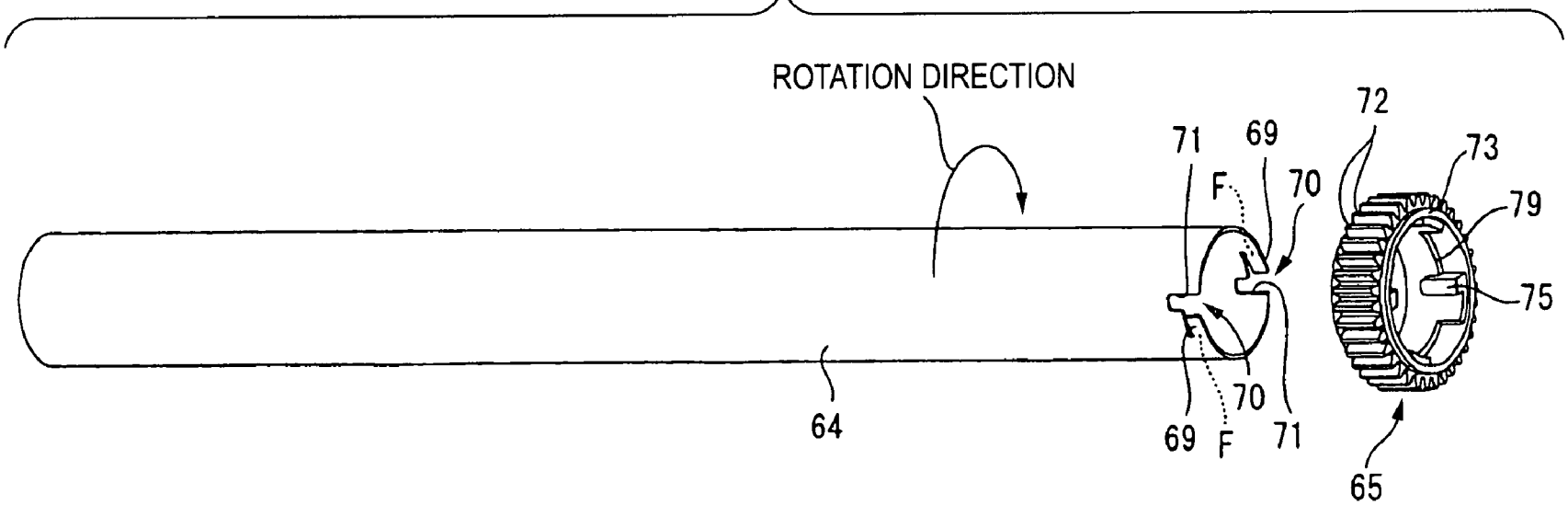
FIG. 8 is an exploded perspective view showing another embodiment as to the metal base pipe and the roller drive gear (in which engagement pieces and concave portions are provided adjacently to each other respectively)

FIG. 8 is an exploded perspective view showing another embodiment as to the metal base pipe 64 and the roller drive gear 65. Parts corresponding to those in the aforementioned embodiment are referenced correspondingly in FIG. 8, and description thereof will be omitted below.

In the metal base pipe 64 shown in FIG. 8, engagement pieces 69 and concave portions 71 are provided adjacently to each other, respectively. That is, in this metal base pipe 64, the concave portions 71 are formed in concave portion formation positions 70 symmetric with the central axis of the metal base pipe 64 respectively. Upstream with respect to the concave portions 71 in the rotation direction (clockwise direction in view from the roller drive gear 65 side) of the metal base pipe 64, notches are made in the circumferential direction of the metal base pipe 64 so as to be continuous to the concave portions 71, respectively. Thus, the engagement pieces 69 are formed adjacently to the concave portions 71 on the upstream side in the rotation direction of the metal base pipe 64, respectively.

On the other hand, the roller drive gear 65 shown in FIG. 8 does not have the cover portion 74 but is formed only out of the gear portion 73.

Figure 9:
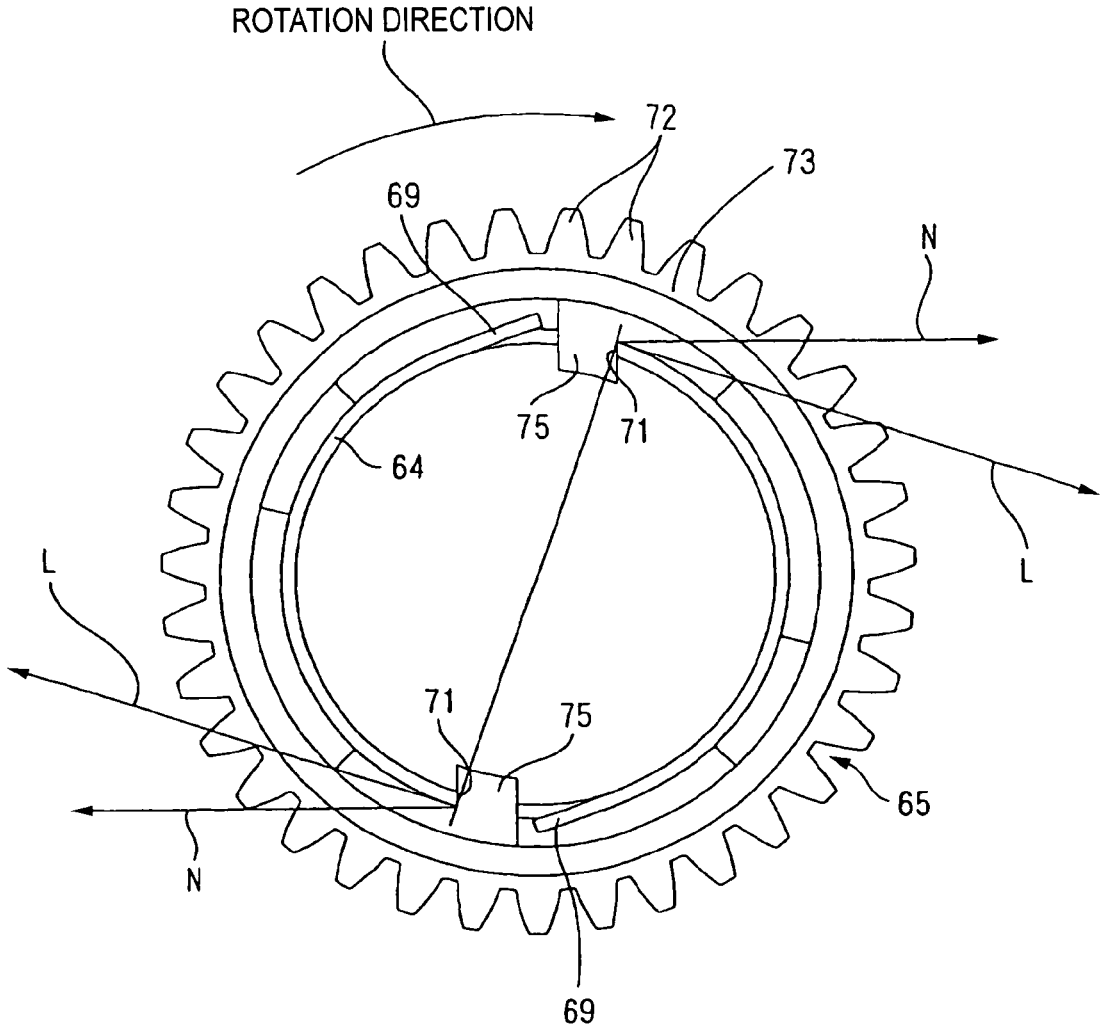
FIG. 9 is a diagram for explaining the direction of a force applied to each convex portion of the roller drive gear shown in FIG. 8.

In addition, in the roller drive gear 65, convex portions 75 to engage with the concave portions 71 of the metal base pipe 64 respectively project so that each convex portion 75 tilts at an acute angle with respect to a tangent L of the metal base pipe 64 extending downstream from the corresponding concave portion 71 in the rotation direction of the metal base pipe 64 in a plane perpendicular to the axial direction of the metal base pipe 64, as shown in FIG. 9, in the state where the roller drive gear 65 has been attached to the metal base pipe 64. Thus, the convex portions 75 are offset with respect the radius of the metal base pipe 64.

Furthermore, in the inner circumferential surface of the gear portion 73, steps 79 are formed upstream in the rotation direction of the metal base pipe 64 with respect to the convex portions 75 respectively, as shown in FIG. 8.

The roller drive gear 65 is attached to the metal base pipe 64 as follows. That is, the metal base pipe 64 and the roller drive gear 65 are positioned so that the concave portions 71 of the metal base pipe 64 are opposed to the convex portions 75 of the roller drive gear 65 respectively. One longitudinal end portion of the metal base pipe 64 is fitted into the gear portion 73 of the roller drive gear 65 so that the concave portions 71 and the convex portions 75 engage each other respectively. After that, a tool (not shown) is inserted into the metal base pipe 64. Each engagement piece 69 is bent outward in the radial direction of the metal base pipe 64 by the tool so as to form a crease F extending in parallel to the central axis of the metal base pipe 64.

Thus, the engagement pieces 69 project to the radially outer side of the metal base pipe 64 so that the free end portions of the engagement pieces 69 are locked in the steps 79 of the inner circumferential surface of the gear portion 73 respectively from the axially outer side of the metal base pipe 64. Thus, the attachment of the roller drive gear 65 to the metal base pipe 64 is attained. In this state, the engagement pieces 69 are locked in the steps 79 respectively so as to restrict the movement of the roller drive gear 65 to the axially outer side of the metal base pipe 64 with respect to the metal base pipe 64. In addition, the convex portions 75 engage with the concave portions 71 respectively, whereby the roller drive gear 65 is also fixed to the metal base pipe 64 in the rotation direction of the metal base pipe 64 and the roller drive gear 65. Therefore, not only is it possible to prevent the roller drive gear 65 from being detached from the metal base pipe 64, but the torque input from a not-shown motor to the roller drive gear 65 can be also transmitted to the metal base pipe 64.

Since the convex portions 75 are offset with respect to the radius of the metal base pipe 64, the direction of a force N to be applied from each convex portion 75 to each concave portion 71 when the torque is transmitted from the roller drive gear 65 to the metal base pipe 64 can be steered to the outer side of the tangent L of the metal base pipe 64 in each concave portion 71. Accordingly, the torque of the roller drive gear 65 can be stably transmitted to the metal base pipe 64. In addition, the convex portions 75 can be prevented from being bent upstream in the rotation direction of the roller drive gear 65 due to stress. Thus, the durability of the roller drive gear 65 can be improved. Further, it is also possible to prevent the metal base pipe 64 from being bent inward.

In addition, the engagement pieces 69 are formed by notches continuous to the concave portions 71 respectively. Accordingly, the engagement pieces 69 adjacent to the concave portions 71 respectively can be formed in the same process as the process of forming the concave portions 71, respectively. It is therefore possible to reduce the number of processes required for processing the metal base pipe 64.

Further, the concave portions 71 are provided adjacently to the engagement pieces 69 respectively on the downstream side in the rotation direction of the metal base pipe 64. Accordingly, the torque transmitted from the roller drive gear 65 to the metal base pipe 64 can be received concentratedly by the concave portions 71. It is therefore possible to further reduce the load on each engagement piece 69 when the metal base pipe 64 is rotating.

Although each engagement piece 69 is designed to be bent to have a crease F extending in parallel to the axial direction of the metal base pipe 64, the crease of each engagement piece 69 may extend in any direction if it is a direction crossing the circumferential direction of the metal base pipe 64. If each engagement piece 69 is bent to have a crease extending in a direction crossing the circumferential direction of the metal base pipe 64, the bent portion of each engagement piece 69 can be prevented from being stretched when a force urging the roller drive gear 65 to the axially outer side of the metal base pipe 64 is applied to the roller drive gear 65. Thus, the roller drive gear 65 can be prevented from dropping out of the metal base pipe 64.

Figure 10:
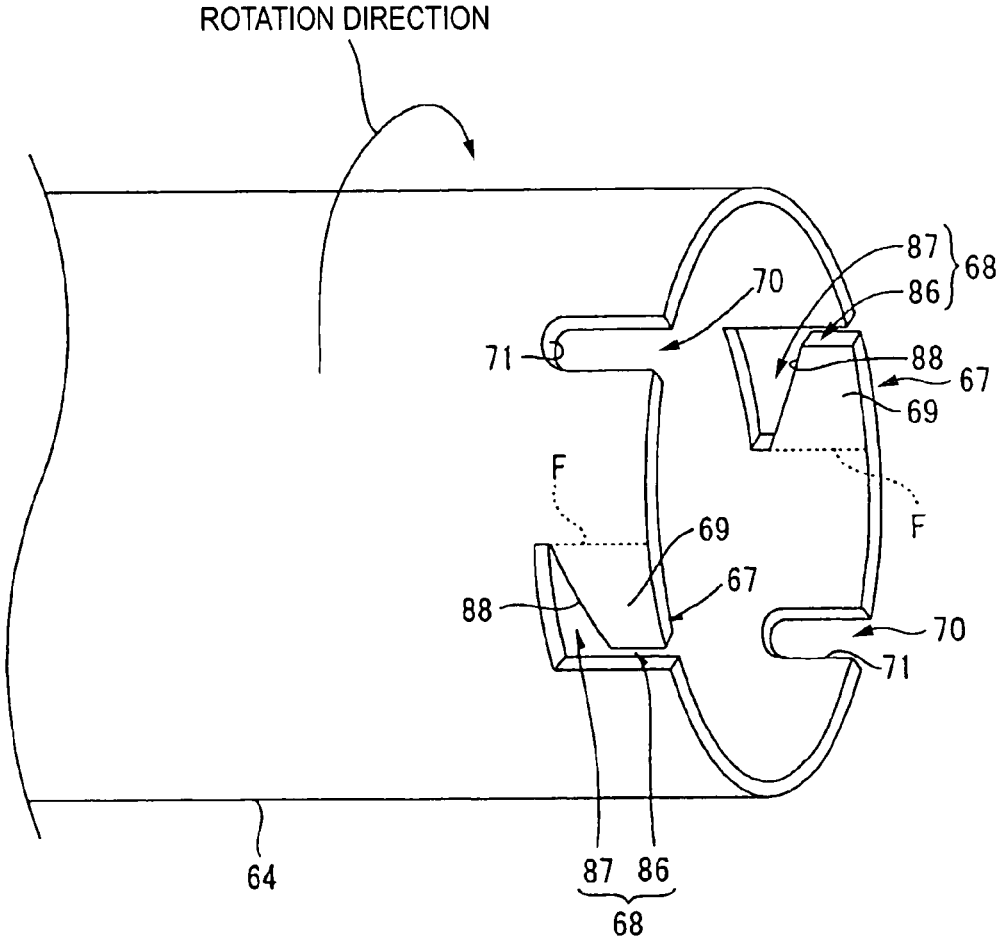
FIG. 10 is a perspective view showing another embodiment as to the metal base pipe (in which each engagement piece has an inclined end surface).

FIG. 10 is an exploded perspective view showing another embodiment as to the metal base pipe 64. Parts corresponding to those in the aforementioned embodiments are referenced correspondingly in FIG. 10, and description thereof will be omitted below.

In one longitudinal end portion of the metal base pipe 64 shown in FIG. 10, notches 68 are made in engagement piece formation positions 67 symmetric with respect to the central axis of the metal base pipe 64, respectively. Each notch 68 includes a straight portion 86 extending inward in the axial direction of the metal base pipe 64 from the edge of the metal base pipe 64, and a triangular portion 87 having an approximately triangular shape extending downstream in the rotation direction of the heating roller 52 from the axially inner end portion of the straight portion 86. Due to the notches 68 designed thus, engagement pieces 69 are formed so that each engagement piece 69 can be bent to have a crease F extending in parallel to the axial direction of the metal base pipe 64, and has an inclined end surface 88 inclined (crossing the end surface of the engagement piece 69 opposed to the straight portion 86 at an angle larger than 90 degrees) with respect to the axial direction of the metal base pipe 64.

The attachment of the roller drive gear 65 (see FIGS. 6A and 6B) to the metal base pipe 64 is performed in the following manner. That is, the concave portions 71 of the metal base pipe 64 are brought into engagement with the convex portions 75 of the roller drive gear 65 respectively. After that, a tool (not shown) is inserted into the metal base pipe 64. Each engagement piece 69 is bent to the radially outer side of the metal base pipe 64 by the tool so as to have a crease F extending in parallel to the central axis of the metal base pipe 64. Thus, the inclined end surfaces 88 of the engagement pieces 69 are locked in the steps 79 of the inner circumferential surface of the roller drive gear 65 from the axially outer side thereof.

According to the configuration arranged thus, the inclined end surfaces 88 of the engagement pieces 69 can be surely locked in the steps 79 of the roller drive gear 65 in spite of a variation in position relationship between each engagement piece 69 and the roller drive gear 65 in the axial direction of the metal base pipe 64. Accordingly, it is possible to prevent looseness between the roller drive gear 65 and the metal base pipe 64.

Although each engagement piece 69 is designed to have an inclined end surface 88, only one of the engagement pieces 69 formed in the engagement piece formation positions 67 may have an inclined end surface 88. In this case, the engagement piece 69 having no inclined end surface 88 (the engagement piece 69 having a shape shown in FIG. 5) is locked in one step 79 of the roller drive gear 65 before the engagement piece 69 having the inclined end surface 88 is locked in the other step 79 of the roller drive gear 65. Thus, the engagement pieces 69 can be surely locked in the steps 79 respectively so that the looseness between the roller drive gear 65 and the metal base pipe 64 can be prevented.

The foregoing description of the embodiments has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application program to enable one skilled in the art to utilize the invention in various embodiments and with various modifications as are suited to the particular use contemplated. It is intended that the scope of the invention be defined by the claims appended hereto, and their equivalents.

What is claimed is:

1. An image forming apparatus comprising:

a cylindrical member made of a metal material;

a gear attached to an end portion of the cylindrical member; and an engagement piece connected to the cylindrical member at a crease and configured to engage with the gear, wherein the engagement piece projects radially outward from the cylindrical member, the crease extending in a direction crossing a circumferential direction of the cylindrical member.

2. The image forming apparatus according to claim 1, wherein the crease extends in a direction parallel to an axial direction of the cylindrical member.

3. The image forming apparatus according to claim 1, wherein a distal end of the cylindrical member where the gear is attached includes a notch.

4. The image forming apparatus according to claim 3, wherein the notch is hook-like in shape.

5. The image forming apparatus according to claim 3, wherein the engagement piece has an end surface that is inclined with respect to an axial direction of the cylindrical member, and wherein the end surface is locked in the gear to engage the engagement piece with the gear.

6. The image forming apparatus according to claim 1, wherein the gear is provided with a cover portion formed to cover an opening of an end portion of the cylindrical member, and wherein the cover portion is provided with a communication hole that allows inside and outside of the cylindrical member to communicate with each other at a position to face the engagement piece in an axial direction of the cylindrical member.

7. The image forming apparatus according to claim 6, wherein the cover portion is provided with an insertion hole for receiving an internal insertion member inside the cylindrical member at a radially inner side of the cylindrical member with respect to the communication hole, and wherein the cover portion is provided with a rib that is formed along a circumference of the insertion hole.

8. The image forming apparatus according to claim 1, wherein the gear is provided with a convex portion that projects toward a radially inner side of the cylindrical member with respect to an end portion of the cylindrical member, and wherein the cylindrical member is provided with a concave portion that engages with the convex portion, the concave portion including a notch at an end portion of the cylindrical member where the gear is attached.

9. The image forming apparatus according to claim 8, wherein the convex portion projects in a direction of inclination at an acute angle with respect to a tangent of the cylindrical member extending from the concave portion downstream in a rotation direction of the cylindrical member in a plane perpendicular to an axial direction of the cylindrical member.

10. The image forming apparatus according to claim 8, wherein a distal end of the cylindrical member includes notches continuous with the concave portion and adjacent to the engagement piece.

11. The image forming apparatus according to claim 10, wherein the concave portion is provided at a position adjacent to the engagement piece downstream in a rotation direction of the cylindrical member with respect to the engagement piece.

12. The image forming apparatus according to claim 8, wherein a pair of the engagement pieces is provided in engagement piece formation positions that are symmetrical with respect to an axis of the cylindrical member, wherein a pair of the concave portions is provided in concave portion formation positions that are symmetrical with respect to the axis of the cylindrical member, and wherein a straight line passing through each of the engagement piece formation positions is configured to be perpendicular to a straight line passing through each of the concave portion formation positions.

13. The image forming apparatus according to claim 1, wherein the cylindrical member is a heating roller that heats and fixes a developer image formed on a recording medium.

14. The image forming apparatus according to claim 1, wherein the engagement piece engages with the gear in a configuration that prevents the gear from detaching from the cylindrical member.

15. A roller comprising:

a cylindrical member made of a metal material;

a gear attached to an end portion of the cylindrical member;

a slit extending from the edge of the end portion; and a crease extending from the edge of the end portion to the slit;

wherein the slit and the crease define a part of the cylindrical member as an engagement piece engaging with the gear, and wherein a distal end of the cylindrical member where the gear is attached includes a notch.

16. The roller according to claim 15, wherein the crease extends in a direction parallel to an axial direction of the cylindrical member.

17. The roller according to claim 15, wherein the notch is hook-like in shape.

18. The roller according to claim 15, wherein the engagement piece has an end surface that is inclined with respect to an axial direction of the cylindrical member, and wherein the end surface is locked in the gear to engage the engagement piece with the gear.

19. The roller according to claim 15, wherein the cylindrical member is a heating roller that heats and fixes a developer image formed on a recording medium.

20. The roller according to claim 15, wherein the engagement piece has a shape of a quadrangle.

21. A roller comprising:

a cylindrical member made of a metal material;

a gear attached to an end portion of the cylindrical member;

a slit extending from the edge of the end portion; and a crease extending from the edge of the end portion to the slit;

wherein the slit and the crease define a part of the cylindrical member as an engagement piece engaging with the gear,and wherein the engagement piece projects radially outward from the cylindrical member.

22. The roller according to claim 21, wherein the crease extends in a direction parallel to an axial direction of the cylindrical member.

23. A roller comprising:

a cylindrical member made of a metal material;

a gear attached to an end portion of the cylindrical member;

a slit extending from the edge of the end portion; and a crease extending from the edge of the end portion to the slit;

wherein the slit and the crease define a part of the cylindrical member as an engagement piece engaging with the gear, wherein the gear is provided with a cover portion formed to cover an opening of an end portion of the cylindrical member, and wherein the cover portion is provided with a communication hole that allows inside and outside of the cylindrical member to communicate with each other at a position to face the engagement piece in an axial direction of the cylindrical member.

24. The roller according to claim 23, wherein the cover portion is provided with an insertion hole for receiving an internal insertion member inside the cylindrical member at a radially inner side of the cylindrical member with respect to the communication hole, and wherein the cover portion is provided with a rib that is formed along a circumference of the insertion hole.

25. A roller comprising:

a cylindrical member made of a metal material;

a gear attached to an end portion of the cylindrical member;

a slit extending from the edge of the end portion; and a crease extending from the edge portion the slit;

wherein the slit and the crease define a part of the cylindrical member as an engagement piece engaging with the gear, wherein the gear is provided with a convex portion that projects toward a radially inner side of the cylindrical member with respect to an end portion of the cylindrical member, and wherein the cylindrical member is provided with a concave portion that engages with the convex portion, the concave portion including a notch at an end portion of the cylindrical member where the gear is attached.

26. The roller according to claim 25, wherein the convex portion projects in a direction of inclination at an acute angle with respect to a tangent of the cylindrical member extending from the concave portion downstream in a rotation direction of the cylindrical member in a plane perpendicular to an axial direction of the cylindrical member.

27. The roller according to claim 25, wherein a distal end of the cylindrical member includes notches continuous with the concave portion and adjacent to the engagement piece.

28. The roller according to claim 27, wherein the concave portion is provided at a position adjacent to the engagement piece downstream in a rotation direction of the cylindrical member with respect to the engagement piece.

29. The roller according to claim 25, wherein a pair of the engagement pieces is provided in engagement piece formation positions that are symmetrical with respect to an axis of the cylindrical member, wherein a pair of the concave portions is provided in concave portion formation positions that are symmetrical with respect to the axis of the cylindrical member, and wherein a straight line passing through each of the engagement piece formation positions is configured to be perpendicular to a straight line passing through each of the concave portion formation positions.

* * * * *